US008491733B2

(12) United States Patent
Trenda

(10) Patent No.: US 8,491,733 B2
(45) Date of Patent: Jul. 23, 2013

(54) ALUMINUM ALLOY OF THE ALZNMG TYPE AND METHOD OF PRODUCING IT

(75) Inventor: Günther Trenda, Dorfgastein (AT)

(73) Assignee: Aluminium Lend Gesellschaft m.b.H., Lend (AT)

( * ) Notice: Subject to any disclaimer, the term of this patent is extended or adjusted under 35 U.S.C. 154(b) by 796 days.

(21) Appl. No.: 12/440,005

(22) PCT Filed: Sep. 3, 2007

(86) PCT No.: PCT/AT2007/000418

§ 371 (c)(1), (2), (4) Date: Dec. 16, 2009

(87) PCT Pub. No.: WO2008/028208

PCT Pub. Date: Mar. 13, 2008

(65) Prior Publication Data

US 2010/0089506 A1 Apr. 15, 2010

(30) Foreign Application Priority Data

Sep. 4, 2006 (AT) ..... A 1472/2006

(51) Int. Cl.
*C22C 21/10* (2006.01)
*C22F 1/053* (2006.01)

(52) U.S. Cl.
USPC ..... 148/417; 148/701; 420/532; 420/541

(58) Field of Classification Search
USPC ..... 148/417, 701; 420/532, 541
See application file for complete search history.

(56) References Cited

U.S. PATENT DOCUMENTS

2004/0089382 A1 * 5/2004 Senkov et al. ..... 148/701

FOREIGN PATENT DOCUMENTS

| | | | |
|---|---|---|---|
| CH | 266 151 | | 1/1950 |
| CH | 266151 | * | 1/1950 |
| CH | 268 244 | | 5/1950 |
| CH | 268244 | * | 5/1950 |
| GB | 598 192 | | 2/1948 |
| GB | 598192 | * | 2/1948 |

OTHER PUBLICATIONS

V.I. Elagin et al., "Properties and use of new high-technology aluminum alloys for the national economy", Tsvetnye Metally, 61-4 CODEN: ISSN:0372-2929, p. 63, 1985.

* cited by examiner

*Primary Examiner* — Roy King
*Assistant Examiner* — Janelle Morillo
(74) *Attorney, Agent, or Firm* — Cozen O'Connor

(57) ABSTRACT

An aluminum alloy of the AlZnMg type, which is suitable for producing low-stress, high-strength aluminum input materials, and to a method for producing such aluminum input materials.

11 Claims, No Drawings

ALUMINUM ALLOY OF THE ALZNMG TYPE AND METHOD OF PRODUCING IT

RELATED APPLICATION

This is a U.S. national stage of application No. PCT/AT2007/000418, filed on Sep. 3, 2007.

This application claims the priority of Austrian Patent application no. 1472/2006, filed Sep. 4, 2006, the entire subject matter of which is hereby incorporated by reference.

FIELD OF THE INVENTION

The invention relates to aluminum alloys, in particular aluminum alloys of the kind that are suitable for producing low-stress, high-strength aluminum input material. The invention furthermore relates to a method for producing such aluminum input materials.

BACKGROUND OF THE INVENTION

For producing complex components from aluminum plates by mechanical machining, for instance of tools for plastic injection molding, low-stress and high-strength input material is required.

The source of stresses in the input material is the internal stresses from the extrusion process, dictated by temperature gradients in casting, as well as internal stresses from the heat treatment; these are stresses caused by the quenching process. In the mechanical machining, stresses in the input material lead to an impairment of dimensional stability and thus to warping of the component. Typically, straightening is impossible because of close tolerances, and the workpieces have to be rejected.

For such usage objectives, the precipitation-hardenable wrought aluminum alloy EN AW-6082, an alloy of the AlMgSilMn type, has become especially well established. For producing plates, this material is cast into rectangular formats by extrusion and then, for molding the alloy elements that have been precipitated at the particle limits and to compensate for casting segregations (differences in concentration of alloy elements) is subjected to a first heat treatment (so-called homogenization). After that, a second heat treatment is effected for adjusting the mechanical properties. Between the first and second heat treatments, a reshaping step (such as rolling) may be effected.

The prior art here is the performance of full hardening, including solution annealing, ensuing quenching in cold water, and subsequent artificial aging. In the solution annealing, the hardness component magnesium silicide $Mg_2Si$ is dissolved by diffusion in the primary mixed crystal at temperatures of about 550° C. for 6 to 10 hours, depending on the format. With the quenching in cold water, which causes cooling to below 150° C. in less than 20 seconds, freezing of the state of equilibrium established at the solution annealing temperature occurs, which corresponds to a state of disequilibrium at room temperature. The ensuing artificial aging at temperatures of 150 to 200° C. for 8 to 15 seconds represents a targeted precipitation of the hardness component for adjusting the strength.

Aluminum bars treated in this way have very good mechanical properties, but because of the internal stresses that are present because of the quenching in cold water, they are unsuitable for use for mechanical machining. The aluminum bars are therefore subjected to a cold working in order to reduce the very great majority of the internal stresses from the quenching process. Following the heat treatment, the aluminum bars are stretched by means of hydraulic systems by from 1 to 5% of the original length.

Aluminum plates produced by this extensive method are distinguished by good mechanical strength, but are only in low-stress form, and warping during the mechanical machining can still occur.

The thermal mechanical strain on such aluminum plates, for instance in plastic injection molding, leads to a steady loss of strength and therefore leads to continuously increasing wear of the tool.

There is accordingly still a need for aluminum alloys from which low-stress, high-strength aluminum input material can be produced, such as a form of cast plates, which input material is suitable for mechanical further machining, for instance for producing base plates for plastic injection molding tools.

SUMMARY OF THE INVENTION

It is therefore an object of the present invention to furnish aluminum alloys from which low-stress and high-strength aluminum input material can be made. It is a further object of the present invention to produce an aluminum alloy which already by reason of its chemical composition can furnish low-stress and high-strength input materials. A further object of the invention is to furnish a posttreatment for a input material produced from an alloy according to the invention, which posttreatment, compared to the full hardening known from the prior art, offers advantages, among others of being more economical and less polluting, and enables further improvement in the strength values of the alloys according to the invention.

These objects are attained according to an embodiment of the invention by an alloy having the following composition:

5.0-5.8% by weight of zinc
1.1-1.2% by weight of magnesium
0.2-0.3% by weight of chromium
0.1-0.3% by weight of manganese
0.1-0.4% by weight of copper
0.05-0.15% by weight of titanium
0.005-0.05% by weight of cerium
0.005-0.05% by weight of samarium
a maximum of 0.2% by weight of silicon
a maximum of 0.3% by weight of iron
a maximum of 0.005% by weight of zirconium
and as the remainder, aluminum.

In a preferred embodiment, the aluminum alloy of the invention includes 5.3-5.5% by weight of zinc, 0.2-0.25% by weight of chromium, 0.2-0.3% by weight of manganese, and 0.3-0.4% by weight of copper.

The aluminum alloy according to the invention is suitable for the production of aluminum input material for ensuing mechanical machining or for use for cold extrusion. Preferably, the aluminum input material is a cast aluminum plate.

A further object of the invention comprises a posttreatment of aluminum input material, produced from an aluminum alloy according to the invention, with the goal of obtaining a low-stress and high-strength aluminum input material that ensures advantageous mechanical properties for the ensuing mechanical machining and the workpieces made from the input material, such as base plates for plastic injection molding tools.

This posttreatment according to an embodiment of the invention contemplates a first heat treatment at up to 480° C., cooling to room temperature, and an ensuing second heat treatment at up to 200° C. Preferably, a natural age hardening at approximately room temperature for from 2 to 5 days is effected before the second heat treatment.

A second heat treatment in two stages has moreover proven especially advantageous for improving the mechanical characteristics. In the first stage, a temperature of 80 to 120° for a duration of 6 to 12 hours is preferably contemplated, while in the second stage, a temperature of 135 to 150° C. for 10 to 16 hours is contemplated.

These objects and further aspects of the present invention will be described in further detail below in terms of examples, which explain the invention in greater detail but do not limit it.

DETAILED DESCRIPTION OF THE EMBODIMENTS

In the literature, the effect of self-hardening (cold hardening) of certain aluminum alloys is described. Especially the aluminum-zinc-magnesium alloy group has a tendency to self-harden, because of the low solubility of zinc in the primary mixed crystal at room temperature.

In a series of experiments, AlZnMg alloys of different compositions have therefore been cast by extrusion into rectangular formats of 1550×250×3000 mm and after complete cold hardening they were tested for their mechanical properties. To that end, a tensile test was performed in accordance with EN 10002-5; the values listed are mean values from 20 tensile specimens each. The AlZnMg alloys were also compared with the known reference alloy EN AW-6082, which was treated in the usual prior art manner.

Experiment A (Not in Accordance with the Invention)

A reference alloy having the composition EN 573-3, material EN AW-6082 was used. This alloy according to standards has the following composition:

0.7-1.3% by weight of silicon
0.5% by weight of iron
0.1% by weight of copper
0.4-1.0% by weight of manganese
0.6-1.2% by weight of magnesium
0.25 chromium
0.2% by weight of zinc
0.1% by weight of titanium
other alloy ingredients:
individually, 0.05% by weight, totaling 0.15% by weight
remainder: aluminum The alloy, in the T651 state, that is, solution-annealed, was quenched, straightened at low stress by 1-3%, warm-hardened, and subjected to mechanical testing. The mechanical characteristics obtained are as follows:

| Tensile Strength $R_M$ [MPa] | 0.2% permanent elongation limit $R_{P0.2}$ [MPa] | Breaking elongation A5 [%] | Brinell Hardness HB 10 |
|---|---|---|---|
| 288 | 248 | 7.5 | 90 |

Experiment 1 (Not in Accordance with the Invention):

Aluminum alloy having the composition of
4.86% by weight of zinc
0.92% by weight of magnesium
0.18% by weight of chromium
0.22% by weight of manganese
0.09% by weight of titanium
0.21% by weight of silicon
0.28% by weight of iron
0.01% by weight of copper
remainder: Aluminum The mechanical characteristics attainable with this alloy are as follows:

| Tensile Strength $R_M$ [MPa] | 0.2% permanent elongation limit $R_{P0,2}$ [MPa] | Breaking elongation A5 [%] | Brinell Hardness HB 10 |
|---|---|---|---|
| 297 | 203 | 7.8 | 100 |

Experiment 2 (Not in Accordance with the Invention):

Aluminum alloy having the composition of
5.18% by weight of zinc
0.94% by weight of magnesium
0.17% by weight of chromium
0.21% by weight of manganese
0.12% by weight of titanium
0.16% by weight of silicon
0.28% by weight of iron
0.01% by weight of copper
remainder: aluminum The mechanical characteristics attainable with this alloy are as follows:

| Tensile Strength $R_M$ [MPa] | 0.2% permanent elongation limit $R_{P0.2}$ [MPa] | Breaking elongation A5 [%] | Brinell Hardness HB 10 |
|---|---|---|---|
| 297 | 203 | 7.8 | 100 |

Experiment 3 (in Accordance with an Embodiment of the Invention):

An aluminum alloy having the composition of
5.61% by weight of zinc
1.18% by weight of magnesium
0.24% by weight of chromium
0.24% by weight of manganese
0.29% by weight of copper
0.06% by weight of titanium
0.02% by weight of cerium
0.01% by weight of samarium
0.12% by weight of silicon
0.26% by weight of iron
0.001% by weight of zirconium
remainder: aluminum The mechanical characteristics attainable with this alloy are as follows:

| Tensile Strength $R_M$ [MPa] | 0.2% permanent elongation limit $R_{P0.2}$ [MPa] | Breaking elongation A5 [%] | Brinell Hardness HB 10 |
|---|---|---|---|
| 338 | 255 | 6.5 | 115 |

For adjusting the mechanical properties, the sample plates produced from the alloys in experiments 1 through 3 were annealed with low stress in a first heat treatment step at 400 to 450° C. for 40 to 80 minutes; after cooling to room temperature at a rate of approximately 200° C./h, a second heat treatment was performed, for shortening the cold hardening, at temperatures of from 85 to 120° C. for 24 to 26 hours.

During the first heat treatment (the low-stress annealing) and the second heat treatment for shortening the cold hardening, a natural age hardening was performed at approximately room temperature for from 2 to 5 days, resulting in a higher 0.2% permanent elongation limit in the input material. This improvement in the permanent elongation limit is ascribed to an increased precipitation of the incoherent phase $MgZn_2$ during the natural age hardening.

The substantially shortened first heat treatment, compared to the usual solution annealing, and the quenching in cold water, which is not required, makes it possible to produce highly low-stress material. Residual stresses, which in a mechanical machining would lead to warping, do not occur in the sample plates. Straightening is therefore unnecessary.

From a comparison of experiments A and 1 through 3, it can be seen that the alloys in experiments 1 through 3 are superior to the currently typically employed alloy A with regard to the mechanical characteristics of tensile strength, breaking elongation, and Brinell hardness. The alloy according to an embodiment of the invention, compared both to the reference alloy and to the alloys of experiments 1 and 2, exhibits significantly higher tensile strength and is distinguished over the reference alloy by a significantly higher value for the Brinell hardness.

Experiment 4 (in Accordance with an Embodiment of the Invention)

A cast aluminum plate comprising an alloy with the composition of experiment 3 was subjected to a posttreatment according to experiment 3, with the distinction that the second heat treatment was performed in two stages. The first stage included a heat treatment at approximately 90° C. for 8 to 10 hours; the second stage included a heat treatment at approximately 145° C. for 14 to 16 hours.

The mechanical characteristics attainable with this alloy are as follows:

| Tensile Strength $R_M$ [MPa] | 0.2% permanent elongation limit $R_{P0.2}$ [MPa] | Breaking elongation A5 [%] | Brinell Hardness HB 10 |
|---|---|---|---|
| 351 | 305 | 2.6 | 130 |

From experiment 4 it can be seen that in the alloy of the invention, as a result of a second heat treatment which is effected in two stages, a further significant improvement in the mechanical characteristics that are of interest in conjunction with the present invention can be attained.

Longer treatment times do not lead to any significant improvement in the mechanical characteristics. Raising the temperature in the second stage, for instance to 160° C., likewise brought no improvement and on the contrary led to a loss of strength.

The temperatures of the heat treatments that are advantageous for attaining the desired mechanical characteristics and the duration of the various heat treatments required for this can vary within the ranges given in the claims, as a function of the composition of the particular aluminum alloy of the invention. The optimal parameters for the particular alloy of the invention, however, can be easily ascertained by one skilled in the art by means of experiments within his competence.

The higher hardness in comparison to the reference alloy increases the resistance to mechanical strain in use; the property of the cold hardening in the alloys of the invention leads to a healing effect of the mechanical properties after thermal strain. The durability for instance of tools for plastic injection molding is increased substantially as a result.

The high hardness of the alloys of the invention in the cold-hardened state, as well as their significantly reduced breaking elongation compared to the reference alloy, also produce very short-breaking chips in metal-cutting machining; the attainable surface quality, characterized by peak to valley height and the visual appearance, is therefore improved in comparison to the reference alloy.

The alloys according to the invention, because of the low contents of silicon and manganese, are furthermore excellently well suited to decorative anodic oxidation. The chromium content reduces the tendency of the alloy of the invention to stress cracking corrosion to a minimum, yet because of the maximum content of 0.3 percent by weight has no negative effect on the anodic oxidation.

The invention claimed is:

1. An aluminum alloy, comprising:
5.0-5.8% by weight of zinc;
1.1-1.2% by weight of magnesium;
0.2-0.3% by weight of chromium;
0.1-0.3% by weight of manganese;
0.1-0.4% by weight of copper;
0.05-0.15% by weight of titanium;
0.005-0.05% by weight of cerium;
0.005-0.05% by weight of samarium;
a maximum of 0.2% by weight of silicon;
a maximum of 0.3% by weight of iron;
a maximum of 0.005% by weight of zirconium;
and as the remainder, aluminum.

2. The aluminum alloy as defined by claim 1, comprising:
5.3-5.5% by weight of zinc;
0.2-0.25% by weight of chromium;
0.2-0.3% by weight of manganese; and
0.3-0.4% by weight of copper.

3. An aluminum alloy as defined by claim 1 for producing aluminum input material for subsequent mechanical machining.

4. An aluminum alloy as defined by claim 1 for producing aluminum input material for cold extrusion.

5. An aluminum alloy as defined by claim 3, wherein the aluminum input material is a cast aluminum plate.

6. An aluminum input material comprising an aluminum alloy as defined by claim 1.

7. The aluminum input material of claim 6 in the form of a cast aluminum plate.

8. A method for producing aluminum input material from an aluminum alloy as defined by claim 1, wherein a posttreatment includes first heat treatment at up to 480° C., cooling down to room temperature, and an ensuing second heat treatment at up to 200° C.

9. The method as defined by claim 8, wherein before the second heat treatment, a natural age hardening at approximately room temperature is effected for from 2 to 5 days.

10. The method as defined by claim 8, wherein the second heat treatment is effected in two stages.

11. The method as defined by claim 10, wherein in the first stage, a temperature of from 80 to 120° C. for a duration of 6 to 12 hours is provided, and in the second stage, a temperature of from 135 to 150° for 10 to 16 hours is provided.

* * * * *